US008919336B2

(12) United States Patent
von Herrmann et al.

(10) Patent No.: US 8,919,336 B2
(45) Date of Patent: Dec. 30, 2014

(54) RADIANT GAS BURNER UNIT

(75) Inventors: Pieter J. von Herrmann, Shaker Heights, OH (US); David Frederick, Hinckley, OH (US)

(73) Assignee: Solarflo Corporation, Bedford Heights, OH (US)

( * ) Notice: Subject to any disclaimer, the term of this patent is extended or adjusted under 35 U.S.C. 154(b) by 567 days.

(21) Appl. No.: 11/833,967

(22) Filed: Aug. 3, 2007

(65) Prior Publication Data

US 2009/0032012 A1 Feb. 5, 2009

(51) Int. Cl.
*F24C 3/04* (2006.01)
*F23D 14/14* (2006.01)

(52) U.S. Cl.
CPC . *F23D 14/14* (2013.01); *F24C 3/04* (2013.01); *F23D 2203/104* (2013.01); *F23D 2212/10* (2013.01)
USPC ... 126/39 J; 126/39 R; 126/41 R; 126/92 AC; 431/326; 431/328

(58) Field of Classification Search
USPC ..... 126/39 J, 92 AC, 92 A, 92 B, 92 C; 431/326, 328
See application file for complete search history.

(56) References Cited

U.S. PATENT DOCUMENTS

| | | | | |
|---|---|---|---|---|
| 1,942,265 | A * | 1/1934 | Teller et al. | 126/214 A |
| 2,415,223 | A | 2/1947 | Stangle | |
| 2,655,991 | A | 10/1953 | Kennedy | |
| 2,696,813 | A | 12/1954 | Clarke | |
| 2,920,177 | A | 1/1960 | Brane | |
| 3,098,477 | A | 7/1963 | Lotter | |
| 3,103,160 | A | 9/1963 | Forniti et al. | |
| 3,114,363 | A | 12/1963 | Koltun | |
| 3,130,482 | A * | 4/1964 | Forniti | 29/890.02 |
| 3,167,110 | A * | 1/1965 | Szell | 431/328 |
| 3,237,679 | A * | 3/1966 | Best | 431/210 |
| 3,263,594 | A | 8/1966 | Appleman | |
| 3,353,583 | A * | 11/1967 | Silhavy et al. | 431/329 |

(Continued)

FOREIGN PATENT DOCUMENTS

WO WO 0062654 A1 * 10/2000

OTHER PUBLICATIONS

Research in Fundamentals of Atmospheric Gas Burner Design; Bulletin No. 10; American Gas Association Testing Laboratories, Cleveland, OH; 1940; pp. 101-109.

(Continued)

*Primary Examiner* — Jorge Pereiro

(57) ABSTRACT

An improved radiant gas burner unit is provided having a shallow base with long walls and shorter walls. The shallow base supports a radiant gas burner plate or plates having openings therethrough, and forming an external surface of the base for emitting high temperature gas radiation. At least three mixing tubes are provided aligned with the shorter wall, and having two open ends. The first open end is positioned within the base and the second open end is positioned adjacent corresponding openings formed through the long wall of the base. A gas supply line extends along the long wall and has gas outlets for ejecting gas across an open air gap positioned intermediate the gas outlet and the second open end of the mixing tubes. The ejected gas is mixed with air as it crosses the air gap, and is provided to the openings of the radiant gas burner plate for combustion which produces high temperature radiation on the radiant gas burner plate and external surface of the base.

18 Claims, 5 Drawing Sheets

(56) References Cited

U.S. PATENT DOCUMENTS

| | | | | | |
|---|---|---|---|---|---|
| 3,413,912 | A | | 12/1968 | Phelan et al. | |
| 3,460,460 | A | | 8/1969 | Bixby et al. | |
| 3,463,139 | A | * | 8/1969 | Kanekichi et al. | 126/39 J |
| 3,528,399 | A | | 9/1970 | Perl | |
| 3,547,097 | A | * | 12/1970 | Rice et. al. | 126/4 |
| 3,799,452 | A | * | 3/1974 | Hein | 239/553.3 |
| 3,848,110 | A | * | 11/1974 | Giguere et al. | 219/525 |
| 4,321,857 | A | * | 3/1982 | Best | 99/340 |
| 4,395,226 | A | * | 7/1983 | Nakanishi et al. | 431/76 |
| 4,413,976 | A | * | 11/1983 | Scherer | 431/278 |
| 4,454,805 | A | | 6/1984 | Matthews | |
| 4,535,750 | A | | 8/1985 | Hebert et al. | |
| 4,561,418 | A | | 12/1985 | Cairns | |
| 4,607,609 | A | * | 8/1986 | Keating | 126/39 J |
| 4,608,012 | A | * | 8/1986 | Cooper | 431/328 |
| 4,627,410 | A | | 12/1986 | Jung | |
| 4,628,897 | A | | 12/1986 | Stanfa et al. | |
| 4,639,213 | A | * | 1/1987 | Simpson | 431/326 |
| 4,662,349 | A | | 5/1987 | McKenzie et al. | |
| 4,683,867 | A | | 8/1987 | Beatty | |
| 4,700,051 | A | | 10/1987 | Goessler | |
| 4,724,823 | A | * | 2/1988 | Simpson | 126/39 R |
| 4,776,319 | A | | 10/1988 | Colangelo et al. | |
| 4,805,588 | A | | 2/1989 | Reynolds | |
| 4,808,798 | A | | 2/1989 | Goessler | |
| 4,886,044 | A | * | 12/1989 | Best | 126/39 C |
| 4,976,609 | A | * | 12/1990 | Grob et al. | 126/373.1 |
| 5,090,899 | A | * | 2/1992 | Kee | 431/326 |
| 5,094,221 | A | | 3/1992 | Ho | |
| 5,117,747 | A | * | 6/1992 | Kuechler | 99/400 |
| 5,154,160 | A | * | 10/1992 | Burtea et al. | 126/21 A |
| 5,186,620 | A | * | 2/1993 | Hollingshead | 431/354 |
| 5,190,027 | A | | 3/1993 | Miceli | |
| 5,195,425 | A | | 3/1993 | Koziol | |
| 5,240,411 | A | * | 8/1993 | Abalos | 431/329 |
| 5,249,953 | A | | 10/1993 | Roth | |
| 5,279,277 | A | | 1/1994 | Barker | |
| 5,368,009 | A | * | 11/1994 | Jones | 126/41 R |
| 5,678,531 | A | | 10/1997 | Byers et al. | |
| 5,833,449 | A | * | 11/1998 | Knight et al. | 431/191 |
| 6,012,444 | A | | 1/2000 | Skender | |
| 6,036,474 | A | * | 3/2000 | Diep et al. | 431/125 |
| 6,114,666 | A | * | 9/2000 | Best | 219/411 |
| 6,176,173 | B1 | * | 1/2001 | Holbrook et al. | 99/401 |
| 6,314,868 | B1 | * | 11/2001 | Christensen et al. | 99/340 |
| 6,314,871 | B1 | * | 11/2001 | Holbrook et al. | 99/401 |
| 6,575,154 | B1 | * | 6/2003 | Freeman et al. | 126/40 |
| 6,655,374 | B1 | * | 12/2003 | Beller et al. | 126/41 R |
| 6,659,765 | B1 | * | 12/2003 | Sen-Yu | 431/328 |
| 6,705,307 | B2 | * | 3/2004 | Alden et al. | 126/41 R |
| 6,860,734 | B2 | * | 3/2005 | Zia et al. | 431/354 |
| 7,082,941 | B2 | * | 8/2006 | Jones et al. | 126/39 H |
| 7,575,000 | B2 | * | 8/2009 | Jones et al. | 126/39 H |
| 2003/0213484 | A1 | * | 11/2003 | Alden et al. | 126/41 R |
| 2005/0000957 | A1 | * | 1/2005 | Jones et al. | 219/450.1 |
| 2006/0003279 | A1 | * | 1/2006 | Best | 431/328 |

OTHER PUBLICATIONS

Primary Air INjection Characteristics of Atmospheric Gas Burners; 6th Bulletin; American Gas Association Testing Laboratories; Clevland, OH, 1944; pp. 24-29.

* cited by examiner

RADIANT GAS BURNER UNIT

FIELD OF INVENTION

The present application is directed to an improved radiant gas burner unit, and more particularly to a shallow radiant gas burner unit with side gas inlets and improved heat distribution.

BACKGROUND

The use of radiant burners is common in connection with conventional cooking and heating systems. The radiating surface of the burner is typically a ceramic plate with densely spaced holes through which a combustible mixture of gas and air flows. The air/gas mixture is ignited at the ceramic surface and combustion takes place at the surface as well as partially in the holes. The velocity of the air/gas mixture through the holes is no less than the backward flame propagation velocity, so that the flame does not travel into the plenum behind the ceramic plate.

Past systems of the type disclosed, for example, in U.S. Pat. No. 6,012,444 provide a radiant burner which is approximately 28 inches by 12 inches. Such units disperse the air/gas mixture within a chamber adjacent to the ceramic plate. The air/gas mixture is dispersed by gas tubes of unequal length positioned longitudinally within the chamber, which dispersion attempts to provide equal gas distribution within the chamber and thus equal heating across and throughout the ceramic plate or plates.

It is important to assure equal heating across and throughout the surface of the ceramic plate to provide maximum and optimum radiation from all parts of the surface, and thus even cooking or heating. At the same time, the flammable gas under the ceramic plate must be the proper mixture of air and gas. For example, methane gas and air mixtures may have a variety of mixture ratios, but radiation efficiency, although difficult to measure, is believed to be optimal for complete combustion at ratios of approximately 10:1. For propane gas and air mixtures, radiation efficiency is more likely optimal for complete combustion at ratios of approximately 24:1.

A high velocity gas jet induces a sufficient quantity of air into the mixing tube or diffuser tube. The quantity of air/gas mixture needed to supply the entire radiating ceramic surface of the unit requires the mixing or diffuser tube to have a relatively large diameter.

In prior art burner units, the large mixing or diffuser tube diameter was responsible for the depth or thickness of the burner unit body behind the ceramic radiating surface, i.e. the overall thickness of the unit. Thus, such prior art burner units are generally thick or deep in the direction "d," or the height or thickness of the burner unit. This height dimension limits use of the burner units to ovens and other applications of conventional size, which are of considerable bulk.

SUMMARY OF THE INVENTION

The burner unit disclosed here is an improved radiant burner that is very shallow in the direction perpendicular to the radiating surface, or a thin radiating burner unit. The decreased size of the unit is enabled by the use of multiple, smaller diameter, shorter mixing tubes, extending across the width of the burner unit, and receiving a fuel/air mixture from multiple gas sources along the side of the burner unit. Additionally, the burner unit of the present application has been shown though experimentation to provide improved heat distribution.

The burner of the present application is a shallow radiating unit that is compatible with outdoor grills which are narrow or slender, or with small sized cooking systems where limited vertical space or height is available. Ovens for boats or recreational vehicles are good examples of cooking systems requiring space limited radiant burner units. In such units, broiling may be performed from the top, over the items to be cooked, while heating may be performed from the bottom, under the items to be cooked. The present unit may be used in either position, or moved between positions. Additionally, the small size of the present improved burner unit may enable the unit to be positioned within a lid or the cover of a conventional grill to provide enhanced broiling options.

Unlike prior art cooking systems which supply or inject the air/gas mixture at the end of the unit to a large single mixing tube running along the majority of the length of the unit, the air/gas mixture is introduced to the present device via multiple inlets, but preferably 3 or more side inlets. Thus, all portions of the ceramic radiating surface are fed equally well and uniform radiation takes place, and in a smaller sized burner unit which was not previously possible.

A gas supply or gas manifold along the edge of the unit guides the gas to the appropriate gas orifice location where inlet air is then induced into the mixing tube. The multiple mixing tubes each handle only a small quantity of air/gas mixture. As a result, the diameter of the mixing tubes of the present device is much smaller. The tubes are also much shorter in length, as compared to conventional prior art radiant burner units. While the use of venturi diffuser tubes is possible, the use of single diameter mixing tubes also accomplishes the necessary air/gas mixture intake just as effectively and at lower cost and ease of manufacture. Baffles are also used in positions intermediate the ceramic plates and the mixing tubes to further enhance the dispersion of the air/gas mixture across the unit. Further, the baffles of the present application are more simple in design than those of the prior art. Thus, the smaller diameter, shorter mixing tubes, together with the more limited mixing and redirecting baffles, permit a much shallower unit. Using the geometry mentioned, the appropriate air/gas mixture is distributed for proper operation across the whole unit.

DETAILED DESCRIPTION

Figure 1:
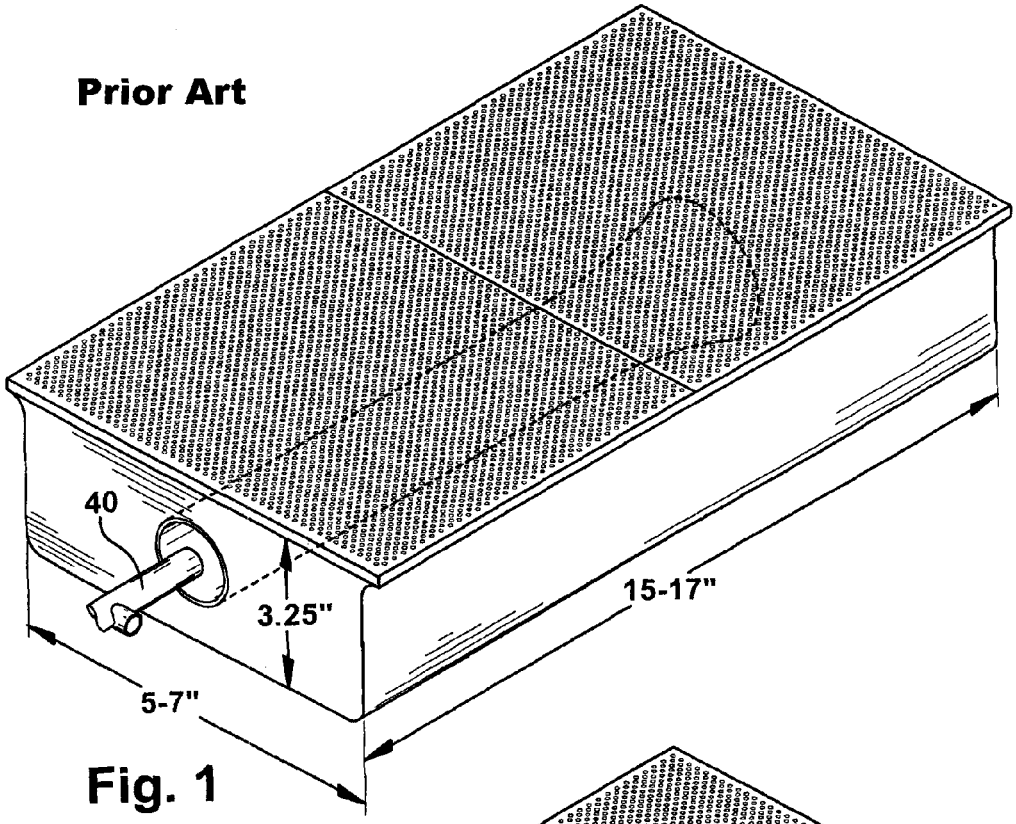
FIG. 1 is a schematic, perspective view of a prior art radiant burner device.
Figure 2:
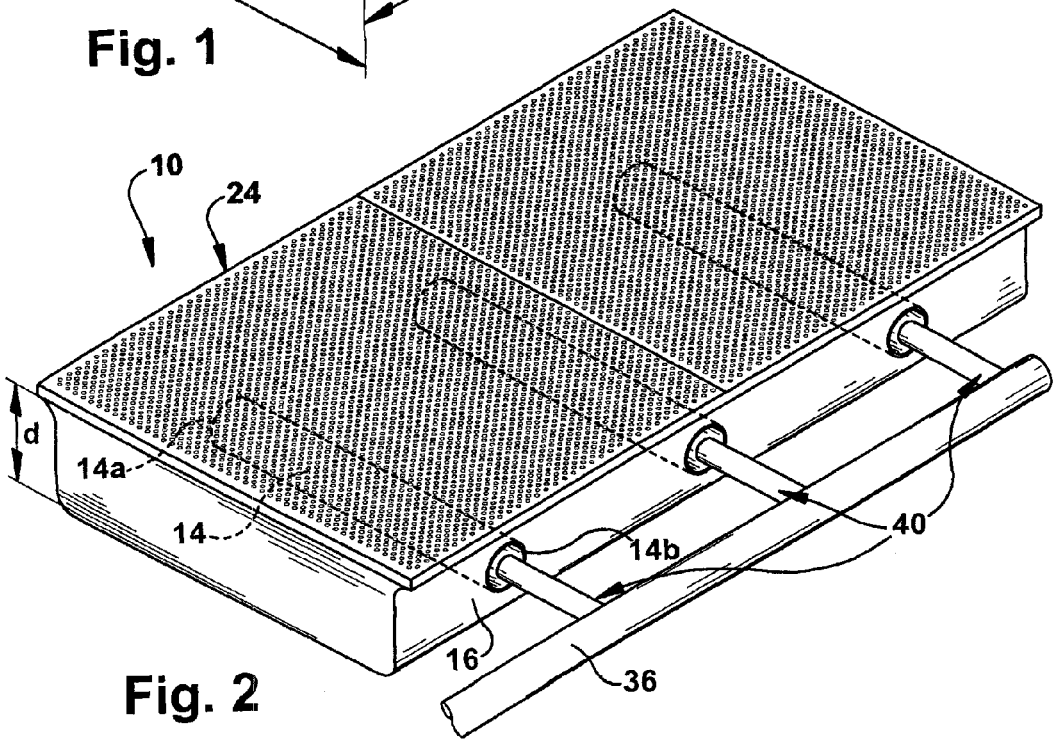
FIG. 2 is a schematic, partial perspective view of the improved radiant burner unit of the present application.
Figure 3:
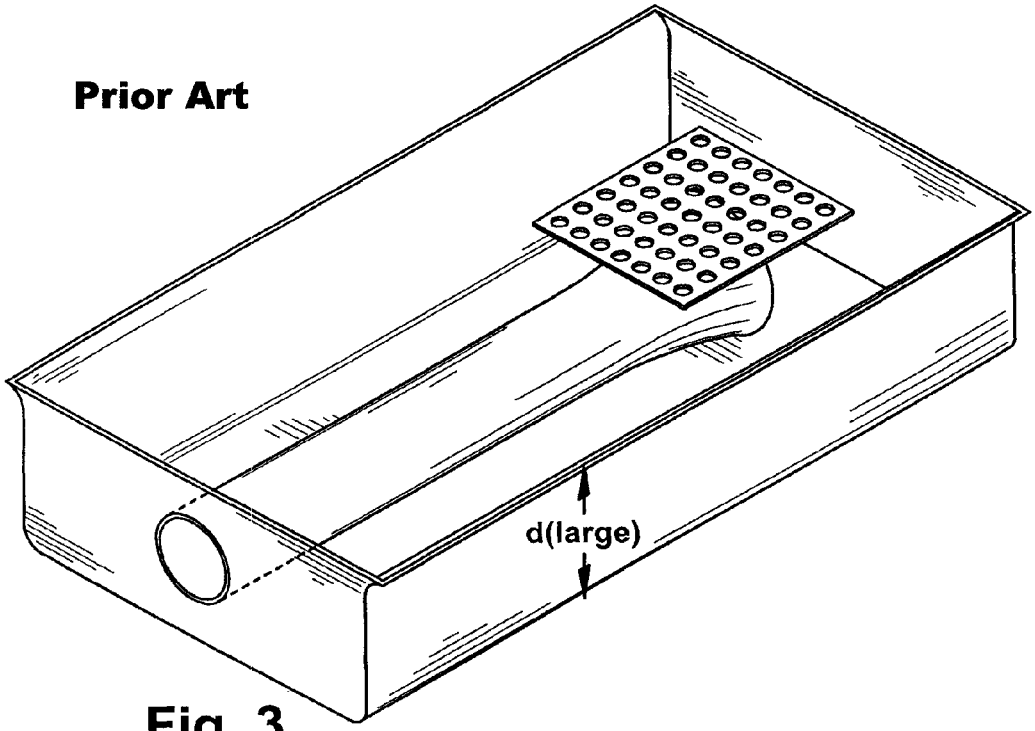
FIG. 3 is a schematic, partial perspective view of a prior art radiant burner device.
Figure 4:
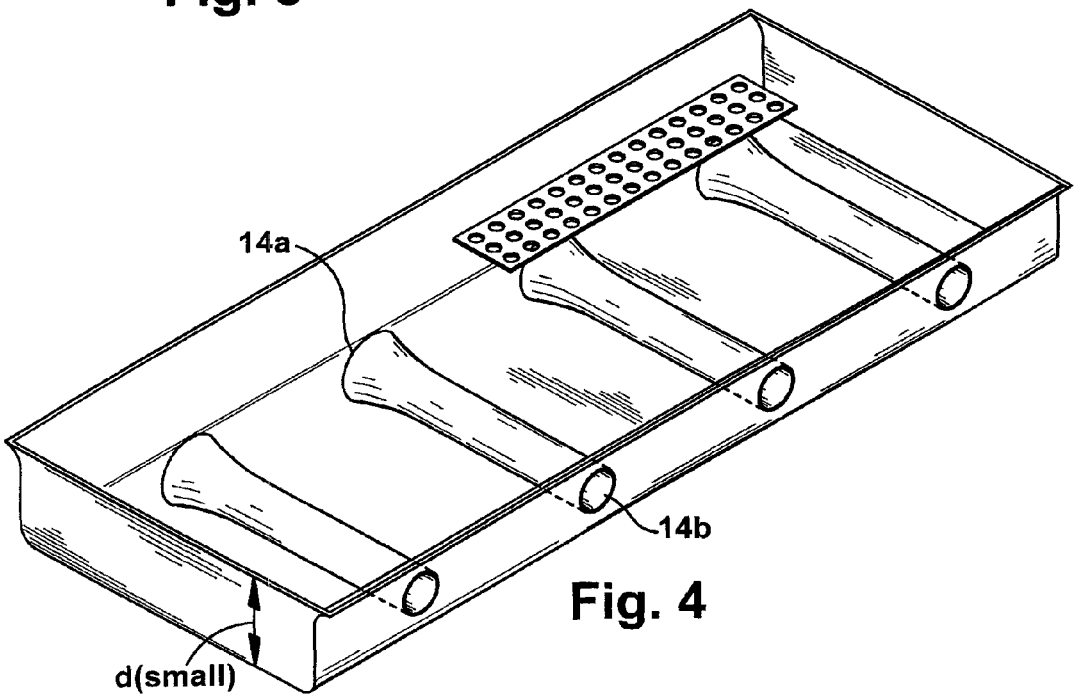
FIG. 4 is a schematic, partial perspective view of the improved radiant burner unit of the present application.
Figure 5:
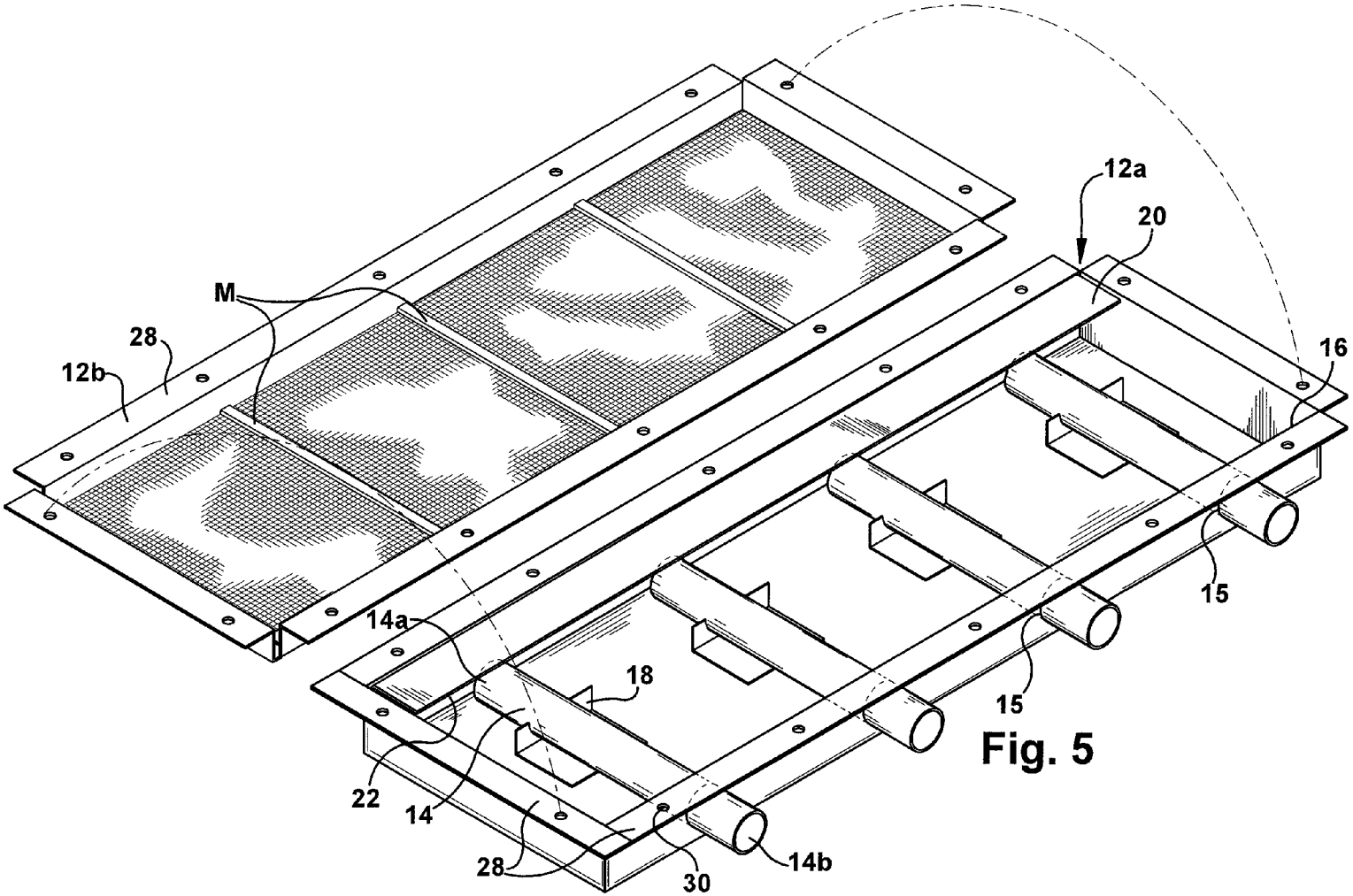
FIG. 5 is a schematic, partial top view of the improved radiant burner unit of the present application, with the ceramic plate removed, as in FIG. 4.
Figure 6:
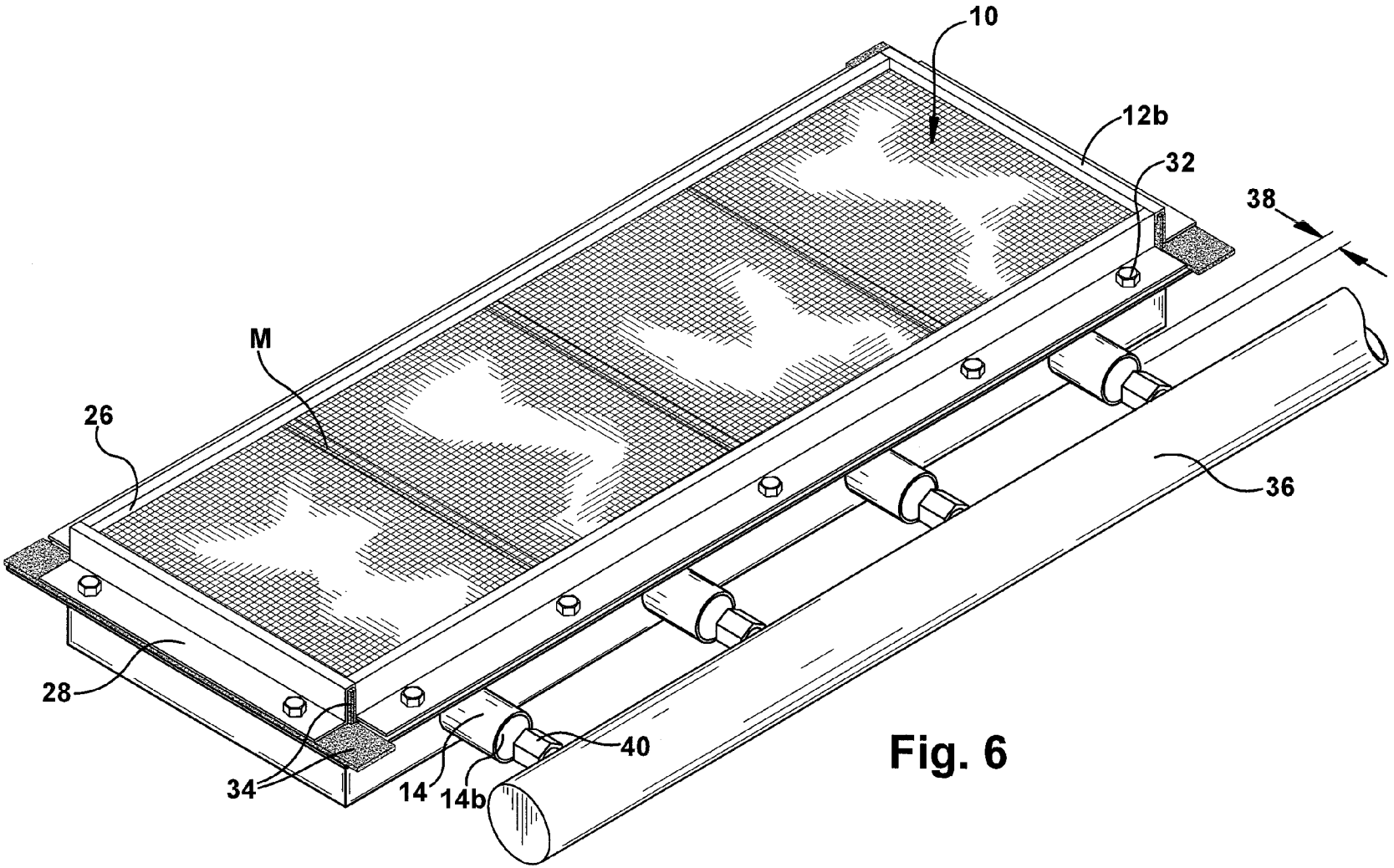
FIG. 6 is a perspective view of the improved radiant burner unit of the present application adjacent a gas source and in operation.

The present application provides an improved radiant gas burner unit 10. General and partial views of the present unit 10 are shown in FIGS. 2 and 4-7, while a prior art radiant gas burner unit is depicted in FIGS. 1 and 3. The present improved unit 10 includes a shallow box or base 12 having two long side walls and two shorter side walls. As shown in FIGS. 5 and 6, the box 12 includes first and second halves 12*a* and 12*b*, respectively. The first half 12*a* of the shallow box 12 supports multiple mixing tubes 14. At least three mixing tubes 14 are provided within the first half 12*b* of the shallow box 12, and extend through spaced openings 15 formed in one long side wall 16 of the shallow box 12, as shown in FIG. 5. Alternatively, the inlet end 14*b* of the mixing tubes 14 may end flush with the side wall 16 of the shallow box, as shown in FIG. 2. In either embodiment, a sufficient gap 38 is provided between the air/gas inlet end 14*b* of the mixing tube 14 and a gas manifold or gas supply 36 having gas outlets 40 located adjacent each of the mixing tubes 14, to enable the proper air/gas mixture to enter the unit 10. The use of a gas supply 36 having multiple gas outlets 40 corresponding to the number of short mixing tubes 14 positioned transversely within the shallow box 12 with respect to the gas supply 36 and the longest edge, or length, of the unit 10, allows a variety of small size advantages to be obtained using the present improved radiant gas burner unit 10. The central axis of each of the mixing tubes 14 is in line with the central axis of the corresponding gas outlets 40.

The mixing tubes 14 are additionally supported spaced from a long side wall 16 within the box 12 on support members 18. The multiple mixing tubes 14 illustrated are less than approximately 6 inches in length, and more preferably between 4 and 5 inches, and have an approximate external diameter of ⅞ inches. The described dimensions in the illustrated embodiment are known to obtain the desired temperature output and efficiency from the present improved infrared gas burner unit 10, and it is likewise known that minor adjustments to such dimensions may obtain similar, but alternative desired results.

A simple baffle 20 is provided over the ends 14*a* of the mixing tubes 14 which are spaced from the wall of the box 12 supporting the openings 15, and through which the air/gas mixture exits the mixing tubes 14. The baffle 20 may be secured along a side wall 22 opposite the side wall 16, either by welding or other fastening means, and, either alternatively or in addition, the baffle 20 may be supported on the ends 14*a* of the mixing tubes 14. The simple baffle 20 may be provided as solid plate material, for example, of stainless steel as in FIG. 5, or as a plate having openings therein, as in FIG. 4, either of which are used to ensure that the air/gas mixture entering the shallow box 12 is dispersed throughout the box 12. The baffle 20 deflects and reflects the air/gas mixture exiting the ends 14*a* of the mixing tubes 14 within the shallow box 12 and ensures even distribution of the air/gas mixture therein.

The second half 12*b* of the shallow box 12 supports an infrared ceramic burner or plate 24. As shown in FIG. 6, multiple commercially available infrared ceramic plates 24 may be used to form a substantially continuous infrared burner surface. Alternatively, a one-piece infrared ceramic burner or plate 24 may be provided. Infrared ceramic plates or grid plates of the type used in the preferred embodiment are available, for example, from entities such as Apogee Engineering Ceramics in Brantford, Ontario, Canada, or Saint-Gobain Ceramics and Plastics, Inc., at www.combustionsolutions.saint-gobain.com. However, it is understood that materials other than ceramic, such as steel mesh may also be used.

The FIG. 6 embodiment of the infrared grid plates discloses ceramic sheets having densely spaced openings, through which the air/gas mixture is burned at the surface and inside the infrared grid plate which is thereby heated to a desired temperature, for example, approximately 870 degrees Celcius or 1,600 degrees Fahrenheit. The infrared ceramic burner plates 24 are held within the second half 12*b* of the shallow box 12 by inwardly directed flanges 26. In the illustrated embodiment of FIG. 6, a joint is provided between the infrared ceramic panels 24, which is preferably a commercially available flexible adhesive material M capable of withstanding the heat generated by the burner during use, which may be in the range of up to 1500° Celcius.

As shown in FIGS. 5 and 6, each of the halves 12*a*, 12*b* of the shallow box 12 are provided with outwardly extending flanges 28 for securing the two halves into the single burner unit 10. As shown in FIG. 5, the flanges 28 on each half of the shallow box 12*a*, 12*b* are provided with aligned openings 30, so that fasteners 32 or other rivets or conventional attachment mechanisms may be provided using the aligned openings 30.

Figure 7:
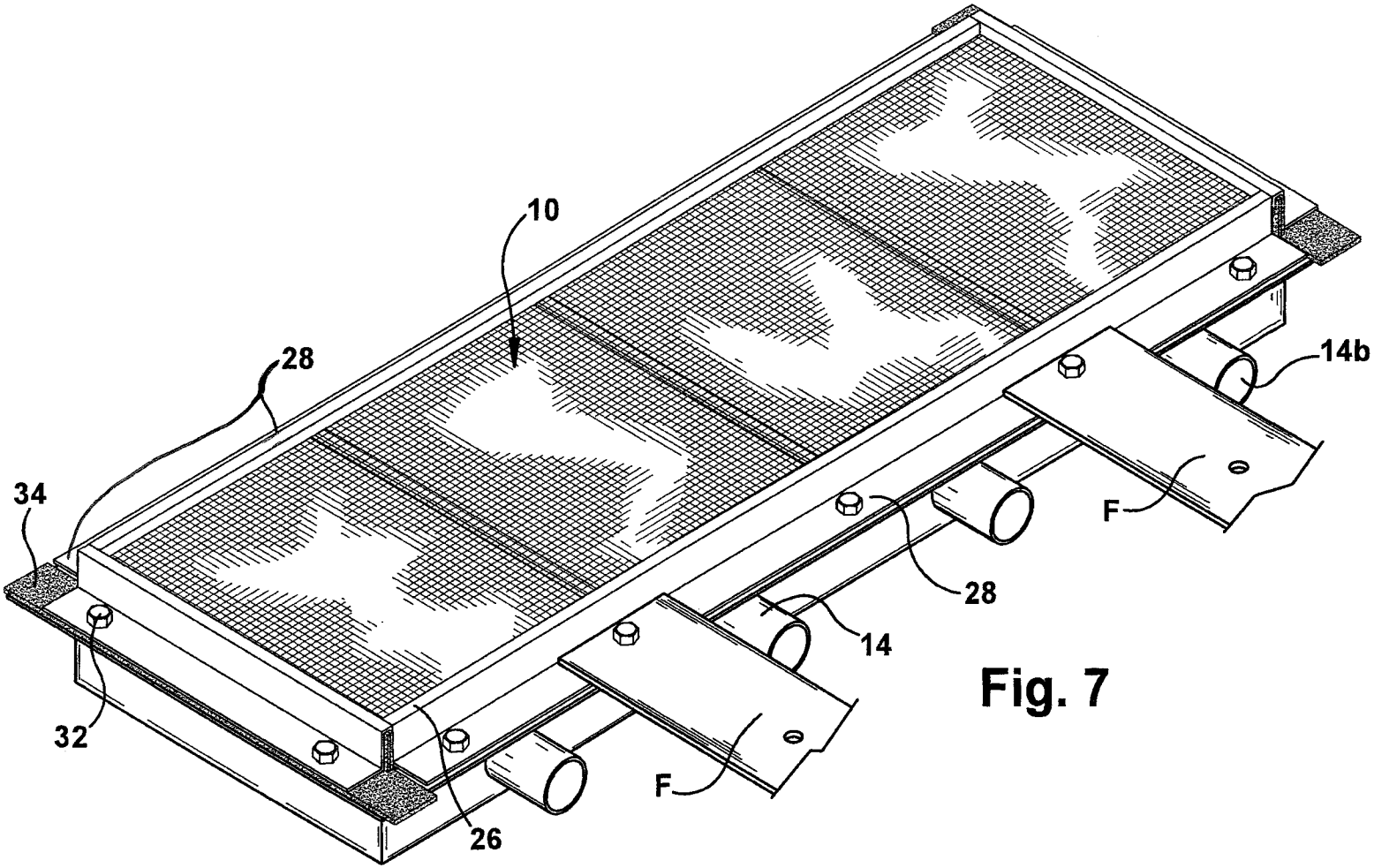
FIG. 7 is a perspective view of the improved radiant burner unit of the present application.

High temperature felt 34 may be used as a seal against leakage again of the air/gas mixture. As shown in FIGS. 6 and 7, strips of high temperature felt 34 are used at the ends of the shallow box 12, intermediate the joined halves 12*a*, 12*b* of the shallow box 12.

During operation of the unit 10, the gas supply 36 positioned along a long side wall 16 of the shallow box 12, supplies the desired fuel to the mixing tubes 14 under atmospheric pressures. The desired fuel may be methane, butane, propane and/or natural gas, as well as alternate fuels. Between the gas supply 36 and an open end 14*b* of the mixing tubes 14, a gap 38 is required. The gap 38 enables the entering fuel to mix with air provided via the gap 38, such that the desired air/gas mixture is supplied to the interior of the shallow box 12 via the diffuser tubes 14. Among a variety of factors (such as diameter of the mixing tube opening), the size of the gap 38 is dependent on the desired air/gas mixture, for example 12:1 for methane, or 37:1 for butane, to be supplied to the unit 10 to enable the desired gas burning efficiency and the desired heat to be provided by the unit 10. Gaps 38 may be provided in the range of 0.0 to 0.5 inches.

The overall size of the present improved radiant gas burner 10 is preferably less than approximately 17 inches in length, less than approximately 6 inches in width, and less than approximately 2 inches in height. In an even more preferred embodiment, the overall dimensions of the radiant gas burner unit 10 is approximately 15 inches in length, approximately 5.5 inches in width and approximately 1.5 inches in height. In this preferred embodiment, the mixing tubes have an external diameter of approximately 1 inch and each of four (4) individual ceramic grid plates are approximately 3.75 inches wide and 5.5 inches wide and 0.5 inches thick.

Attachment flanges 28 of any type and dimension may extend from or be attached to the shallow box 12, including additional strengthening flanges F of the type shown in FIG. 7. Such flanges F may be secured to the flanges 28 on the shallow box 12, and extend for engagement, for example, within the lid of a conventional or modified grill, or a small oven for use in a small space, such as a recreational vehicle. It is understood that a variety of changes may be made to the overall dimensions of the present improved radiant gas burner unit 10 to achieve the desired external size requirements of a particular application for the burner unit 10, while retaining the desired efficiency and functionality of the unit 10.

Additional advantages and modifications to the present improved gas burner unit 10 will be readily apparent to those skilled in the art. The invention in its broader aspects is therefore not limited to the specific details or representative examples described. Accordingly, while care has been taken to provide details concerning the specific preferred features of the present improved gas burner unit, departures may be made from the detail described here without departing from the spirit or scope of the disclosed general inventive concept and the following claims.

We claim:

1. An improved radiant gas burner unit comprising:

a base supporting a substantially flat radiant gas burner plate having openings therethrough, the radiant gas burner plate forming an external surface of the base supporting high temperature radiant gas combustion;

one or more mixing tubes partially supported within the base spaced from one another, and having two open ends, with the first open end positioned within the base and the second open end extending through corresponding openings formed through a wall of the base, said openings having a diameter of approximately one inch or less, such that the overall unit height is approximately 2 inches or less;

a gas supply having gas outlets positioned along the gas supply at locations aligned with and spaced from the second open ends of the mixing tubes to receive a desired gas supplied by the gas supply which is mixed with air at a predetermined desired ratio as the air/gas mixture enters the mixing tubes and is substantially evenly supplied to and through the openings of the radiant gas burner plate to provide high temperature combustion along the external surface of the base.

2. The improved radiant gas burner unit of claim 1, further including a baffle comprising a sheet secured at a position within the base over the first open ends of the mixing tubes.

3. The improved radiant gas burner unit of claim 2, wherein the baffle is formed by a single solid plate.

4. The improved radiant gas burner unit of claim 2, wherein the baffle is a perforated plate.

5. The improved radiant gas burner unit of claim 1, wherein the mixing tubes have a single diameter of 1 inch or less.

6. An improved radiant gas burner unit comprising:

a base having a first and second long walls and two shorter walls, with the long walls having a longer dimension than the shorter walls, and the base supporting a substantially flat radiant gas burner plate having openings therethrough, the radiant gas burner plate forming an external surface of the base supporting high temperature radiant gas combustion;

at least two mixing tubes, each having a central axis aligned with the shorter walls, the mixing tubes partially supported within the base spaced from one another, and having two open ends, with the first open end positioned within the base and the second open end extending through corresponding openings formed through the first long wall of the base, said openings having a diameter of approximately one inch or less, such that the overall unit height is approximately 2 inches or less;

gas supply outlets extending transversely with respect to the first long wall and positioned along a gas supply at locations aligned with and spaced from the second open ends of the mixing tubes to receive a desired gas supplied by the gas supply which is mixed with air at a predetermined desired ratio as the air/gas mixture enters the mixing tubes and is substantially evenly supplied to and through the openings of the radiant gas burner plate to provide high temperature combustion along the external surface of the base.

7. The improved radiant gas burner unit of claim 6, wherein a baffle is secured within the base positioned substantially over the open ends of the mixing tubes within the base.

8. The improved radiant gas burner unit of claim 6, having an air gap located intermediate the gas outlets and the second open end of the mixing tubes.

9. The improved radiant gas burner unit of claim 6, wherein the radiant gas burner plate is ceramic.

10. The improved radiant gas burner unit of claim 6, wherein the radiant gas burner plate is stainless steel mesh.

11. An improved radiant gas burner unit comprising:

a base having a long wall and a shorter wall, the base supporting a substantially flat radiant gas burner plate having openings therethrough, and the radiant gas burner plate forming an external surface of the base supporting high temperature radiant gas combustion;

at least three mixing tubes, each having a central axis substantially aligned with the shorter wall, and having two open ends, the first open end positioned within the base and the second open end positioned adjacent corresponding openings formed through the long wall of the base, said openings having a diameter of approximately one inch or less, such that the overall unit height is approximately 2 inches or less;

a gas supply extending parallel with the long wall and having gas outlets for ejecting gas perpendicular to the gas supply and across an open air gap intermediate the gas outlet and the base, the ejected gas mixed with air at a predetermined desired ratio to be provided to the second open end of the mixing tubes and through the openings of the radiant gas burner plate to provide high temperature combustion along the external surface of the base.

12. An improved radiant gas burner unit for a cooking grill comprising:

a base having a long wall and a shorter wall, the base supporting a substantially flat radiant gas burner plate having perforations therethrough, and the radiant gas burner plate forming an external surface of the base for emitting high temperature gas radiation;

at least three mixing tubes substantially aligned with respect to the shorter wall, and having two open ends, the first open end positioned within the base and the second open end positioned adjacent openings formed through the long wall of the base, said openings having a diameter of approximately one inch or less, such that the overall unit height is approximately 2 inches or less;

a gas supply extending along the long wall and having gas outlets for ejecting gas from the gas supply and across an open air gap positioned intermediate the gas outlet and the second open ends of the mixing tubes, the ejected gas is mixed with air at a predetermined desired ratio and provided through the perforations of the radiant gas burner plate to emit high temperature radiation along the external surface of the base.

13. The improved radiant gas burner unit of claims 6, 11 or 12, wherein the internal diameter of the mixing tubes has a venturi configuration.

14. The improved radiant gas burner unit of claims 6, 11 or 12, wherein the mixing tubes have a straight internal diameter.

15. The improved radiant gas burner unit of claim 12, wherein the straight internal diameter is approximately 1 inch or less.

16. The improved radiant gas burner unit of claims 6, 11 or 12, wherein a baffle of sheet material is secured within the base at a position over the first open ends of the mixing tubes within the base.

17. The improved radiant gas burner unit of claim 16, wherein the baffle is formed by a single solid plate.

18. The improved radiant gas burner unit of claim 16, wherein the baffle is a perforated plate.

* * * * *